US006580893B2

(12) United States Patent
Ishizuka

(10) Patent No.: US 6,580,893 B2
(45) Date of Patent: Jun. 17, 2003

(54) FIXING DEVICE AND IMAGE FORMING APPARATUS INCLUDING THE DEVICE

(75) Inventor: Jiro Ishizuka, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/944,067

(22) Filed: Sep. 4, 2001

(65) Prior Publication Data

US 2002/0048471 A1 Apr. 25, 2002

(30) Foreign Application Priority Data

Sep. 6, 2000 (JP) ..... 2000-270134
Jan. 22, 2001 (JP) ..... 2001-013557

(51) Int. Cl.[7] ..... G03G 15/20
(52) U.S. Cl. ..... 399/325
(58) Field of Search ..... 399/325, 324, 399/350

(56) References Cited

U.S. PATENT DOCUMENTS

| | | | | |
|---|---|---|---|---|
| 2,404,689 A | * | 7/1946 | Carlsen et al. | 15/256.51 |
| 5,043,769 A | * | 8/1991 | Osawa et al. | 399/351 |
| 5,552,867 A | * | 9/1996 | Sekino et al. | 399/284 |
| 5,563,695 A | * | 10/1996 | Sakurai et al. | 399/327 |
| 5,608,508 A | | 3/1997 | Kumagai et al. | 399/339 |
| 5,729,818 A | | 3/1998 | Ishizuka et al. | 399/400 |
| 5,903,799 A | | 5/1999 | Saito et al. | 399/69 |
| 5,966,578 A | | 10/1999 | Soutome et al. | 399/333 |
| 6,088,546 A | | 7/2000 | Inoue et al. | 399/45 |
| 6,219,522 B1 | | 4/2001 | Ishizuka et al. | 399/333 |
| 6,272,307 B1 | | 8/2001 | Ishizuka et al. | 39/325 |

FOREIGN PATENT DOCUMENTS

| | | | |
|---|---|---|---|
| JP | 6-289745 | * | 10/1994 |
| JP | 7-219378 | | 8/1995 |
| JP | 7-295422 | | 11/1995 |
| JP | 8-30132 | * | 2/1996 |
| JP | 10-198212 | * | 7/1998 |
| JP | 2001034103 | * | 2/2001 |

* cited by examiner

*Primary Examiner*—Quana M. Grainger
(74) *Attorney, Agent, or Firm*—Fitzpatrick, Cella, Harper & Scinto

(57) ABSTRACT

A fixing device has fixation and pressure rollers in pressure contact with each other, and an application roller for applying release agent onto the fixation roller and a regulation blade for regulating an amount of the release agent so applied. The regulation blade abuts the application roller so that an extension direction of the regulation blade towards the application roller is substantially counter to a circumferential moving direction of the application roller and is provided with a chamfer at a corner between major and minor surfaces of the regulation blade at a chamfer angle of 30–70 degrees between an extension direction of the major surface and the chamfer of the regulation blade. The regulation blade abuts the application roller at an abutting angle of 30–50 degrees between the major surface and a tangent line of the application roller.

11 Claims, 6 Drawing Sheets

FIXING DEVICE AND IMAGE FORMING APPARATUS INCLUDING THE DEVICE

FIELD OF THE INVENTION AND RELATED ART

The present invention relates to a fixing device for an image forming apparatus for fixing an image formed on a recording material surface and an image forming apparatus using the fixing device. More specifically, the present invention relates to a fixing device for heat-fixing a yet unfixed image formed on a recording material by passing and conveying the recording material between a pair of a fixation roller and a pressure roller under pressure, and an image forming apparatus using the fixing device, particularly a color image forming apparatus comprising a heat fixing device and a plurality of image forming means.

Heat fixing devices have been widely used as means for fixing a yet unfixed image formed through an electrophotographic process, i.e., a yet unfixed toner image formed on a surface of a recording material such as paper.

Image forming apparatus using such fixing devices includes color image forming apparatus as shown in FIGS. 3 and 4 wherein image formation is performed by using four color toners.

Referring to FIG. 3, the color image forming apparatus comprises a color laser beam printer M using four drums provided with four independent light scanning means for four colors, respectively. More specifically, the laser beam printer M includes four image forming means (image forming stations) Pa, Pb, Pc and Pd for four colors disposed in succession. Each image forming station includes a drum-shaped electrophotographic photosensitive member as a latent image-bearing member (hereinafter, referred to as "photosensitive drum"), and a developing device using a prescribed color toner and a transfer device integrally disposed around a peripheral surface of the photosensitive drum.

In each of the (four) image forming stations, an image formed on the photosensitive drum is transferred onto a recording material such as paper carried on a conveyance means. The conveyance means is disposed along the respective (four) image forming stations, so that the respective color toner images formed on the corresponding photosensitive drums are successively transferred on the recording material carried on the conveyance means to the fixing device where the respective color toner images (yet unfixed images) are heat-fixed at the same time.

FIG. 4 is an enlarged sectional view of the four image forming stations described above.

Referring to FIG. 4, the four image forming stations Pa, Pb, Pc and Pd are used for forming toner images of magenta, cyan, yellow and black, respectively.

Each image forming station Pa (Pb, Pc, Pd) includes a rotatable photosensitive drum 1*a* (1*b*, 1*c*, 1*d*), and other members including a charger 12*a* (12*b*, 12*c*, 12*d*), a developing device 2*a* (2*b*, 2*c*, 2*d*) for supplying a corresponding color toner, and a cleaner 4*a* (4*b*, 4*c*, 4*d*) successively disposed along the rotation direction of the photosensitive drum 1*a* (1*b*, 1*c*, 1*c*). On a downstream side of the respective developing devices 2*a*–2*d*, i.e., below the photosensitive drums 1*a*–1*d* on FIG. 4, a transfer unit 3 is disposed. The transfer unit 3 includes a transfer belt 31 carrying thereon the recording material used common to the respective image forming stations Pa–Pd and four transfer chargers 3*a*, 3*b*, 3*c* and 3*d* disposed opposite to the photosensitive drums 1*a*, 1*b* and 1*d*, respectively.

In the above-mentioned color laser beam printer, paper P (as the recording material) supplied from a paper supply cassette 61 is conveyed to the respective image forming stations Pa–Pd while being supported on the transfer belt 31. Thereafter, the respective color toner images formed on the respective photosensitive drums 1*a*–1*d* are successively transferred onto the paper P carried on the transfer belt 31. After the succession of transfer steps for the respective color toner images is completed, the paper P having thereon yet unfixed color toner images is separated from the transfer belt 31 to be conveyed to the fixing device (fixing unit) 5 by a conveyance belt 62 (shown in FIG. 3) as a recording material-guiding means.

FIG. 5 is a schematic sectional view of an embodiment of a conventional heat fixing device (as described, e.g., in Japanese Laid-Open Application (JP-A) No. 7-219378) as the fixing device (unit) 5 shown in FIG. 3.

Referring to FIG. 5, the heat fixing device includes a pair of rotatably disposed rollers, i.e., a fixation roller 51 and a pressure roller 52 pressing the fixation roller 51 via the paper P (recording material) carrying thereon a yet unfixed image, and further includes a release agent application means 53 as a means for supplying and applying a release agent onto the surface of the fixation roller 51 and roller cleaning means 54 and 55. Inside the fixation roller 51 and the pressure roller 52, heaters 56 and 57 (e.g., halogen lamps) are disposed, respectively. Further, thermistors 58 and 59 are disposed in contact with the surfaces of the fixation roller 51 and the pressure roller 52, respectively, whereby voltages supplied to the heaters 56 are controlled through a temperature control circuit to adjust surface temperatures of the fixing roller 51 and the pressure roller 52 to desired temperatures.

The roller cleaning means 54 provided to the fixation roller 51 has a cleaning function of removing, e.g., toner particles detached from the surface of the paper P and attached to the fixation roller surface at the time of fixation. On the downstream side of the cleaning means 54 with respect to the rotation direction (indicated by an arrow) of fixation roller 51, the release agent application means 53 is provided to the fixation roller 51. After the cleaning (removal of toner particles), a release agent such as a silicone oil is applied onto the surface of the fixation roller 51 by the release agent application means 53. The release agent is used for facilitating the separation of the paper P (recording material) from the fixation roller 51 after the fixing step and preventing an occurrence of offset phenomenon of toner particles during the fixation.

The cleaning means 54 includes a cleaning web 54*a* comprising an elongated heat-resistant nonwoven fabric, a pressing roller 54*b* for pressing the cleaning web 54*a* against the fixation roller 51, a feeding roller 54*c* for feeding a fresh cleaning web 54*a*, and a take-up roller for gradually winding up the cleaning web 54*a* lowered in cleaning performance due to the attachment of toner particles. Particularly, in order to prevent an occurrence of detection failure of the thermistor 58 caused by the attachment of toner particles detached from the paper surface to the thermistor used for monitoring the surface temperature of the fixation roller 51, the cleaning means 54 is disposed on the upstream side of the fixation roller 51 with respect to the rotation direction thereof.

In the cleaning means 54 shown in FIG. 5, the cleaning web is wound up in such a manner that a prescribed amount of the cleaning web 54*a* is wound up in a direction opposite to the rotation direction of the fixation roller 51 by energizing a solenoid (not shown) to actuate a one-way clutch when a prescribed number of sheets of paper P is counted by a counting means (counter) provided to the image forming apparatus (laser beam printer). The take-up operation in the direction opposite to the fixation roller rotation direction prevents the cleaning web 54*a* from being wound up towards the fixation roller side by the rotation of the fixation roller 51.

On the other hand, the release agent application means 53 includes an oil tank (container) 53*a* containing therein an release agent such as a silicone oil, conveyance rollers 53*b* and 53*c* for carrying and supplying the release agent from the oil tank 53*a*, an application roller 53*d* for applying the release agent supplied via the conveyance rollers 53*b* and 53*c* onto the surface of the fixation roller 51, and a regulation blade 53*e* for regulating an amount of the release agent applied onto the surface of the application roller 53*d*. Particularly, in order to ensure a uniform application of the release agent (e.g., silicone oil) onto the fixation roller surface, the release agent application means 53 is disposed on the downstream side with respect to the rotation direction of the fixation roller 51. As a result, the release agent once applied onto the fixation roller surface is not removed by the thermistor 58 contacting the fixation roller 51.

The application roller 53*d* may, e.g., be formed of a sponge rubber coated with a silicone rubber layer in a roller shape and is rotatable together with the fixation roller 51. The release agent present on the surface of the application roller 53*d* is transferred onto the fixation roller 51 during the rotation of the application roller 53*d* while abutting the fixation roller 51, thus effecting application of the release agent onto the fixation roller 51.

The regulation blade 53*e* may generally comprise an elastic blade of, e.g., fluorine-containing rubber and is disposed fixedly in abutment with the application roller 53*d*. An excessive amount of the release agent supplied via the conveyance rollers 53*b* and 53*c* is removed from the surface of the application roller 53*d* by abutting the regulation blade 53*e* against the application roller 53*d*. At the time of abutment of the regulation blade 53*e* with the application roller 53*d*, an amount of the release agent present on the application roller surface is effectively regulated so as not to be outside an appropriate range.

The pressure roller 52 is provided with the cleaning means 55 having the same mechanism as the cleaning means 54 for the fixation roller 51. Specifically, the cleaning means 55 includes a cleaning web 55*a*, a pressing roller 55*b*, a feeding roller 55*c*, and a take-up roller 55*d*. Although the pressure roller 52 do not directly contact the yet unfixed toner, a part of the toner detached from the recording material can be attached onto the pressure roller 52 in some cases. The thus attached toner to the pressure roller 52 is removed by the cleaning means 55.

The release agent applied onto the fixation roller 51 is also attached onto the surface of the pressure roller 52 during the abutment with the fixation roller 51. In order to remove the thus excessive amount of release agent present on the pressure roller surface, the pressure roller 52 is provided with a removal blade 60 for removing the release agent disposed in abutment with the pressure roller 52. If the removal blade 60 is not provided to the pressure roller 52, the excessive amount of release agent accumulated on the pressure roller surface remains at a nip between the pressure roller 52 and the fixation roller 51 where the pressure roller 52 abuts the fixation roller 51 via the recording material. As a result, the release agent can, e.g., be attached onto the surface of the recording material to result in stains in some cases. In the case where a transparent laminate film for overhead projector (OHP film) having a very small friction coefficient compared with paper is used as the recording material, the OHP film is liable to slip to cause an occurrence of conveyance failure to the nip formed between the pair of (fixation and pressure) rollers 51 and 52.

The removal blade 60 is formed of, e.g., a silicone rubber or a fluorine-containing rubber, and is disposed in abutment with the pressure roller 52 with an appropriate pressing depth in a forward or reverse direction with respect to the rotation direction of the pressure roller 52.

When the recording material (e.g., paper P) is conveyed to the above-described fixing device, the pair of fixation roller 51 and pressure roller 52 is rotated and a release agent such as a silicone oil is applied onto the surface of fixation roller 51. The recording material is subjected to heating and pressing at substantially constant temperature and pressure from both sides thereof at the time of passing between the pair of rotating rollers 51 and 52. As a result, a yet unfixed toner (image) is melted and fixed on the recording material to complete full-color image formation. The recording material subjected to fixation of the yet unfixed toner image is separated from the pressure roller 52 by a separation claw 68 to be sent to the outside of the image forming apparatus.

In the above-mentioned conventional image forming apparatus using the heat fixing device, when a relatively lower process speed (image forming rate) of, e.g., ca. 10 sheets/min. for paper (or at a further lower process speed for OHP film) is employed, it is possible to effect a smooth heat fixation and a subsequent discharge operation with no fixation failure.

However, it has been found that the above-mentioned heat fixing device is liable to be accompanied with the following difficulties when the fixing device is used as it is in a high-speed image forming apparatus.

Specifically, for example, when a full-color (toner) image is formed on paper at a process speed of ca. 10 sheets/min., it is possible to form the full-color image with no difficulty even if an amount of a release agent (e.g., silicone oil) applied onto the fixation roller is at most 10 mg/A4-size sheet.

On the other hand, if the number of (image forming) sheets formed per 1 min. is further increased (i.e., a process speed of not less than 10 sheets/min.), the sheets of recording material (paper in this case) is conveyed at shorter intervals. In this case, unless an amount of a release agent applied onto the fixation roller is increased, separation failure of recording material from a roller after fixation is liable to occur. In order to prevent the separation failure, it has been found that an amount of the recording material should be regulated in a range of ca. 20–30 mg/A4-sized sheet.

However, in the above-mentioned conventional fixing device as shown in FIG. 5, it was difficult to stably regulate an appropriate amount (20–30 mg/A4-sized sheet) of the applied release agent by using the release agent application means 53. In some cases, the application amount of release agent exceeded 30 mg/A4-sized sheet or the release agent was localized, whereby the release agent such as silicone oil was attached onto the surface of the recording material in a streak form, thus staining the recording material (i.e., occurrence of streak-shaped oil).

The amount of release agent applied onto the fixation roller 51 is directly proportional to the amount of release agent present on the application roller 53*d* abutting the fixation roller 51, so that the application amount of release agent on the fixation roller 51 is controlled by the regulation blade 53*e* for regulating an amount of release agent applied to the application roller 53*d*. More specifically, the amount of release agent (applied to the application roller 53*d*) is regulated by appropriately setting abutting conditions (such as abutting angle and abutting pressure) of the regulation blade 53*e* with respect to the application roller 53*d* or appropriately changing an edge shape of the regulation blade 53*e*. For example, when the edge shape is changed to be acute, an amount of removed release agent is increased to lower the application amount of release agent to the fixation roller 51. On the other hand, when the edge shape is changed to be round, the removal amount of release agent is decreased to increase the release agent application amount.

In the case where the regulation blade 53*d* having an edge shape as shown in FIG. 5 was used, the amount of release agent applied to the application roller 53*d* could readily be set to be a smaller amount of, e.g., at most 10 mg/A4-sized sheet but it was difficult to stably regulate the release agent application amount in a range of 20–30 mg/A4-sized sheet. Even when the application amount was once regulated in the range of 20–30 mg/A4-sized sheet, the regulated amount was liable to became unstable, thus causing such a phenomenon that the applied release agent (such as silicone oil) slipped through the abutting portion with the application roller 53*d*. As a result, the slipped release agent was attached onto the recording material (particularly on the OHP film) in the form of streaks at the time of fixation, thus lowering a resultant image quality.

In order to solve the above problem such that the regulated amount of release agent is liable to become ununiform, it is effective to utilize a regulation blade 53*e* having a chamfered or beveled abutting edge against the application roller 53*d*. Examples of such a chamfered regulation blade 53*e* may include one described in JP-A 7-295422.

By using such a chamfered regulation blade, when compared with the regulation blade as shown in FIG. 5, it becomes possible to stably control the regulated amount of release agent (e.g., silicon oil) but has been found to be accompanied with the following difficulty.

By using the chamfered regulation blade, the amount of release agent present on the application roller surface is considerably increased when compared with the case of using the regulation blade having a rectangular edge (90 degree-edge) as shown in FIG. 5. However, under some abutting conditions, a chamfered regulation blade 53*e* disposed, e.g., as shown in FIG. 6 causes a phenomenon such that the release agent slipped through the abutting portion (edge T2) of the regulation blade 53*e* with the application roller 53*d* is gradually accumulated on a surface A of the regulation blade. When the amount of the accumulated release agent at the surface A is increased, the excessively accumulated release agent is dropped on the surface of the application roller 53*d*. The resultant drops of the release agent are applied onto the fixation roller 51 as they are, thus leading to attachment of the release agent (e.g., silicone oil) in the form of drops onto the image region of the recording material. The attached drop-like release agent remains as stains on the image region, thus causing image failure.

SUMMARY OF THE INVENTION

A principal object of the present invention is to provide a fixing device and an image forming apparatus having solved the above-mentioned problems.

A specific object of the present invention is provide a fixing device of a heat fixation scheme capable of performing a smooth fixation operation and a subsequent discharge operation particularly with no fixation failure even when used in a high-speed image forming apparatus.

Another object of the present invention is to provide a fixing device for an image forming apparatus capable of suppressing a ununiformity in application amount of a release agent such as a silicone oil and preventing an occurrence of image failure due to dropping of the release agent onto an image region of a recording material, such as paper or OHP film, particularly OHP film.

A further object of the present invention is to provide an image forming apparatus including the above-mentioned fixing device of heat fixation scheme.

According to the present invention, there is provided a fixing device for an image forming apparatus for heat-fixing a yet unfixed image formed on a recording material by passing and conveying the recording material between a pair of rollers, comprising:

a pair of a fixation roller and a pressure roller which are rotatably disposed in contact with each other under pressure, and application means for applying a release agent onto the fixation roller, including at least an application roller disposed in contact with the fixation roller and a regulation blade for regulating an amount of the release agent applied onto the surface of the application roller; wherein the regulation blade is disposed to abut the application roller so that an extension direction of the regulation blade towards the application roller is substantially counter to a circumferential moving direction of the application roller and is provided with a chamfer at a corner between major and minor surfaces of the regulation blade at a chamfer angle of 30–70 degrees between an extension direction of the major surface and the chamfer of the regulation blade, the regulation blade being disposed to abut the application roller at an abutting angle of 30–50 degrees between the major surface and a tangent line of the application roller at a position in abutment with the regulation blade.

By using the above release agent application means, it becomes possible to readily regulating an amount of the release agent to be applied onto the application roller (consequently the fixation roller) in an appropriate range, thus preventing ununiformity in application amount of release agent and image failure due to a dropping of release agent caused by an excessive amount of release agent slipped through an abutting portion (e.g., edge T2 shown in FIG. 6) of the regulation blade with the application roller.

In the present invention, the release agent may preferably be an oil, more preferably a silicone oil.

The present invention also provides an image forming apparatus including image forming means and the above-mentioned fixing device.

In this case, the image forming means may preferably be divided into a plurality of image forming means for forming images of a plurality of colors (e.g., magenta, cyan, yellow, black), respectively, thus allowing a full-color image formation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
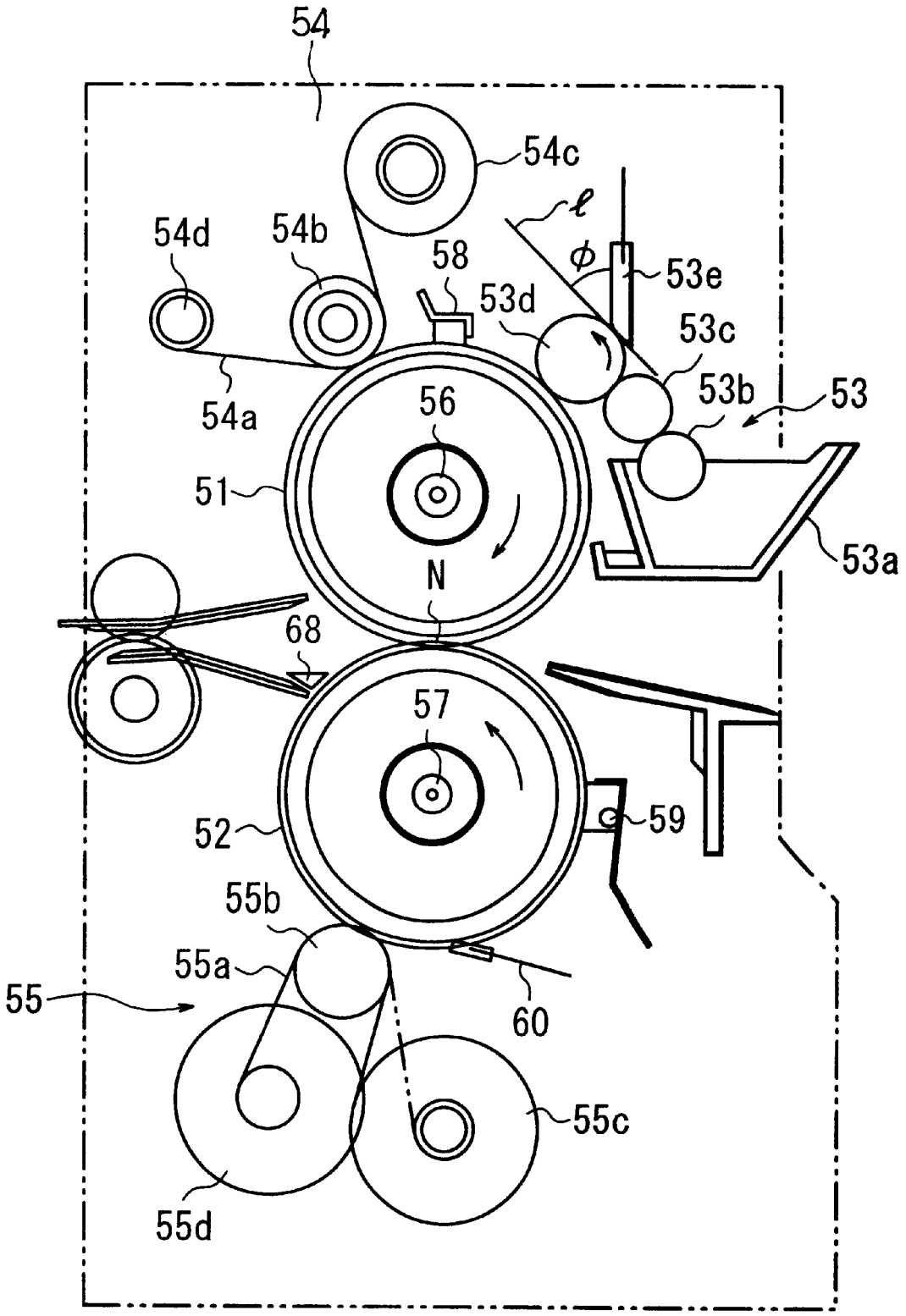
FIG. 1 is a schematic sectional view of an embodiment of the fixing device according to the present invention.

FIG. 1 shows an embodiment of the fixing device according to the present invention.

Figure 5:
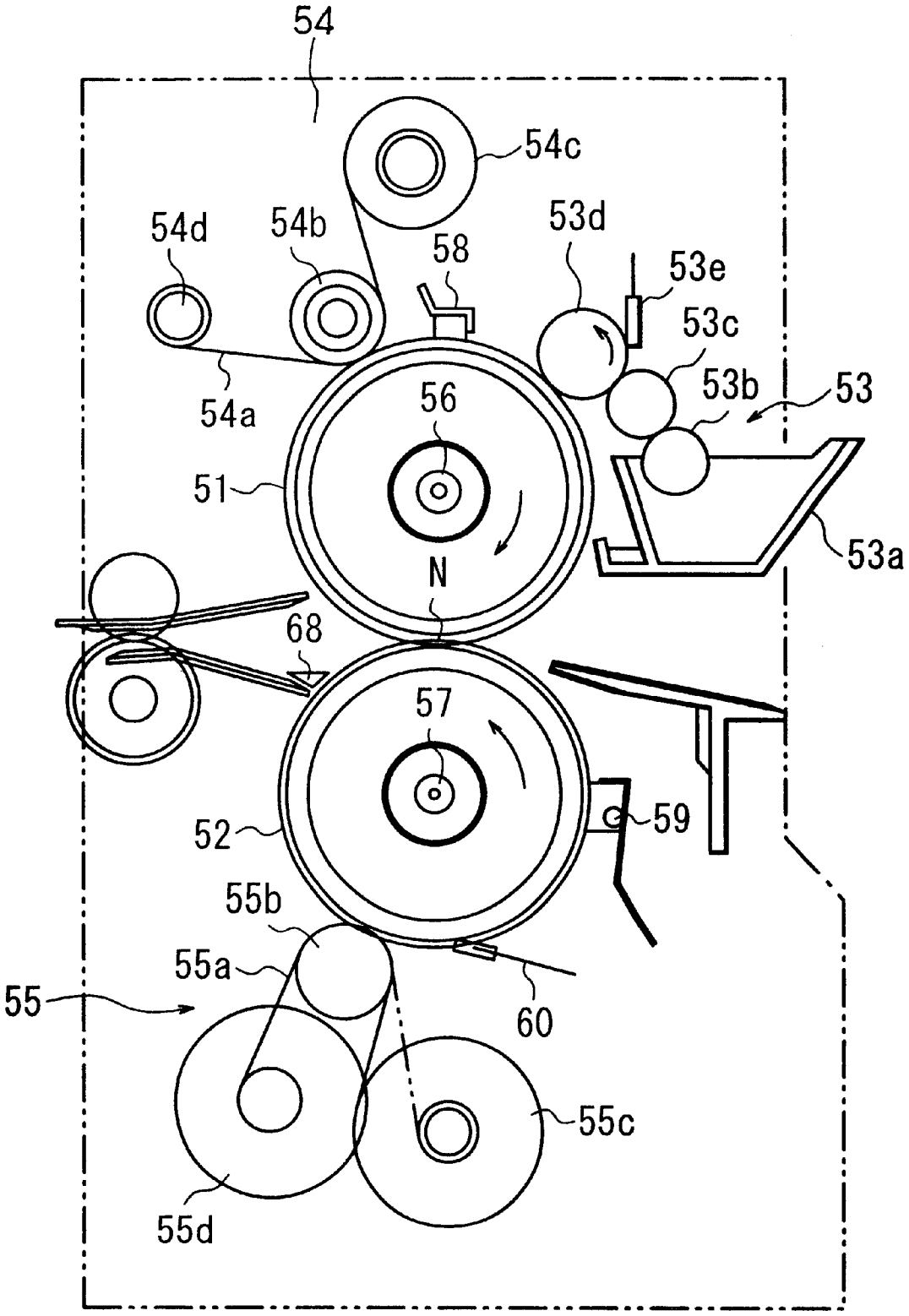
FIG. 5 is an enlarged view of an embodiment of a fixing device used in the conventional image forming apparatus shown in FIG. 3.

In FIG. 1, identical reference numerals are used for describing respective structural members identical to those used in the conventional fixing device shown in FIG. 5

Referring to FIG. 1, similarly as in the conventional fixing device shown in FIG. 5, the fixing device of the present invention includes a release agent application means 53 comprising at least an application roller 53*d* and a regulation blade 53*e* disposed in abutment with the application roller 53*d* so that an extension direction of the regulation blade 53*e* towards the application roller 53*d* is substantially counter to a circumferential moving direction of the application roller 53*d*.

Figure 2:
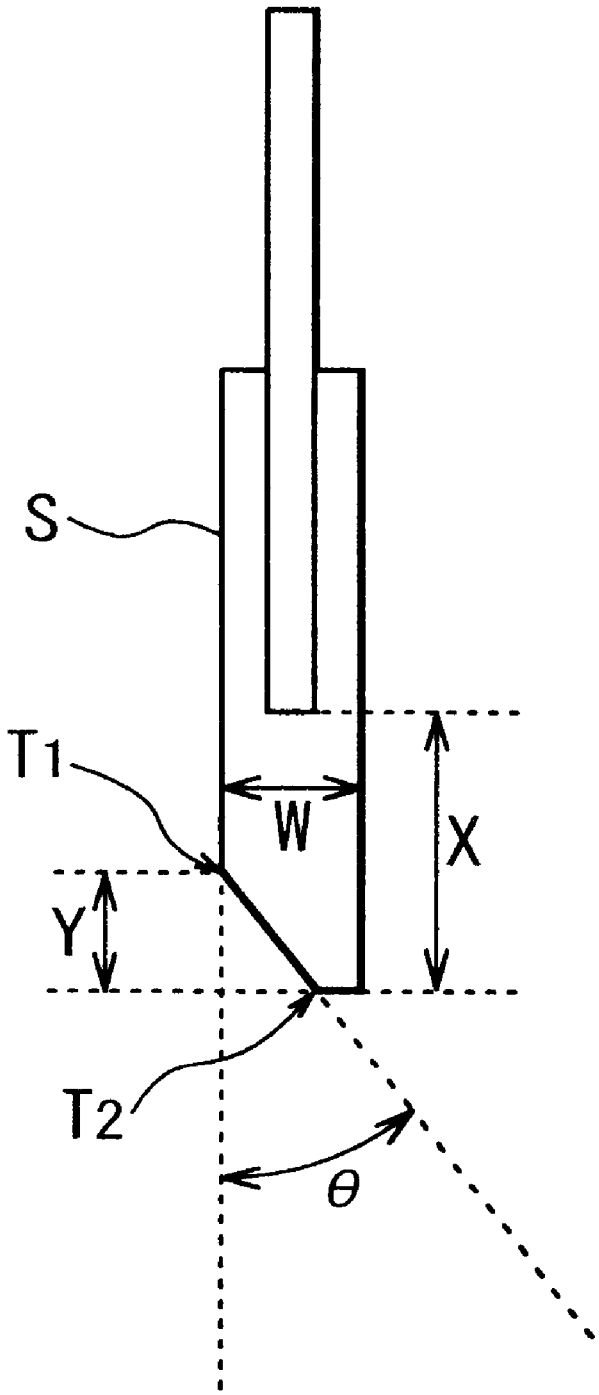
FIG. 2 is an enlarged view of an embodiment of a regulation blade used in the fixing device shown in FIG. 1.

The regulation blade 53*e* used in the fixing device of the present invention is provided with a chamfer at a chamfer angle θ of 30–70 degrees between an extension direction of a surface S and the chamfer of the regulation blade 53*e* as shown in FIG. 2.

In the present invention, the regulation blade 53*e* is disposed in an initial state to abut the application roller 53*d* at an abutting edge (or corner) T1 shown in FIG. 2 at an abutting angle ø of 30–50 degrees between the surface S and a tangent line 1 of the application roller 53*d* at a position in abutment with the edge T1 of the regulation blade 53*e*, as shown in FIG. 1.

With respect to the abutting angle ø, if the regulation blade 53*e* abuts the application roller 53*d* at the surface S, the abutting angle ø is 0 degree, and if the regulation blade 53*e* abuts the application roller 53*d* at a surface perpendicular to the surface S, the abutting angle ø is 90 degrees.

In the present invention, the regulation blade 53*e* is disposed in its initial state in abutment with the application roller 53*d* as described above, whereby it becomes possible to uniformize an amount of the release agent applied to the application roller 53*d* in an axis direction of the application roller 53*d*.

The chamfered regulation blade 53*e* is effective in stably providing a sufficient amount of the applied release agent required of a heat-fixation type fixing device particularly allowing smooth fixation and discharge operations with no fixation failure even when used in a high-speed image forming apparatus. In addition to the chamfer, the regulation blade 53*e* is designed to have the chamfer angle θ of 30–70 degrees and disposed in abutment with the application roller 53*d* at the abutting angle ø of 30–50 degrees, whereby it is possible to effectively suppress a release agent dropping phenomenon such that an excessive amount of release agent slipped through an abutting portion between the application roller 53*d* and the above-mentioned regulation blade 53*e* and gradually accumulated at the surface A as shown in FIG. 6 is dropped on the application roller 53*d* to cause image failure, e.g., when an amount of the release agent (such as silicon oil) finally applied onto the fixing roller 51 is set to be in the range of 20–30 mg/A4-sized sheet.

Figure 6:
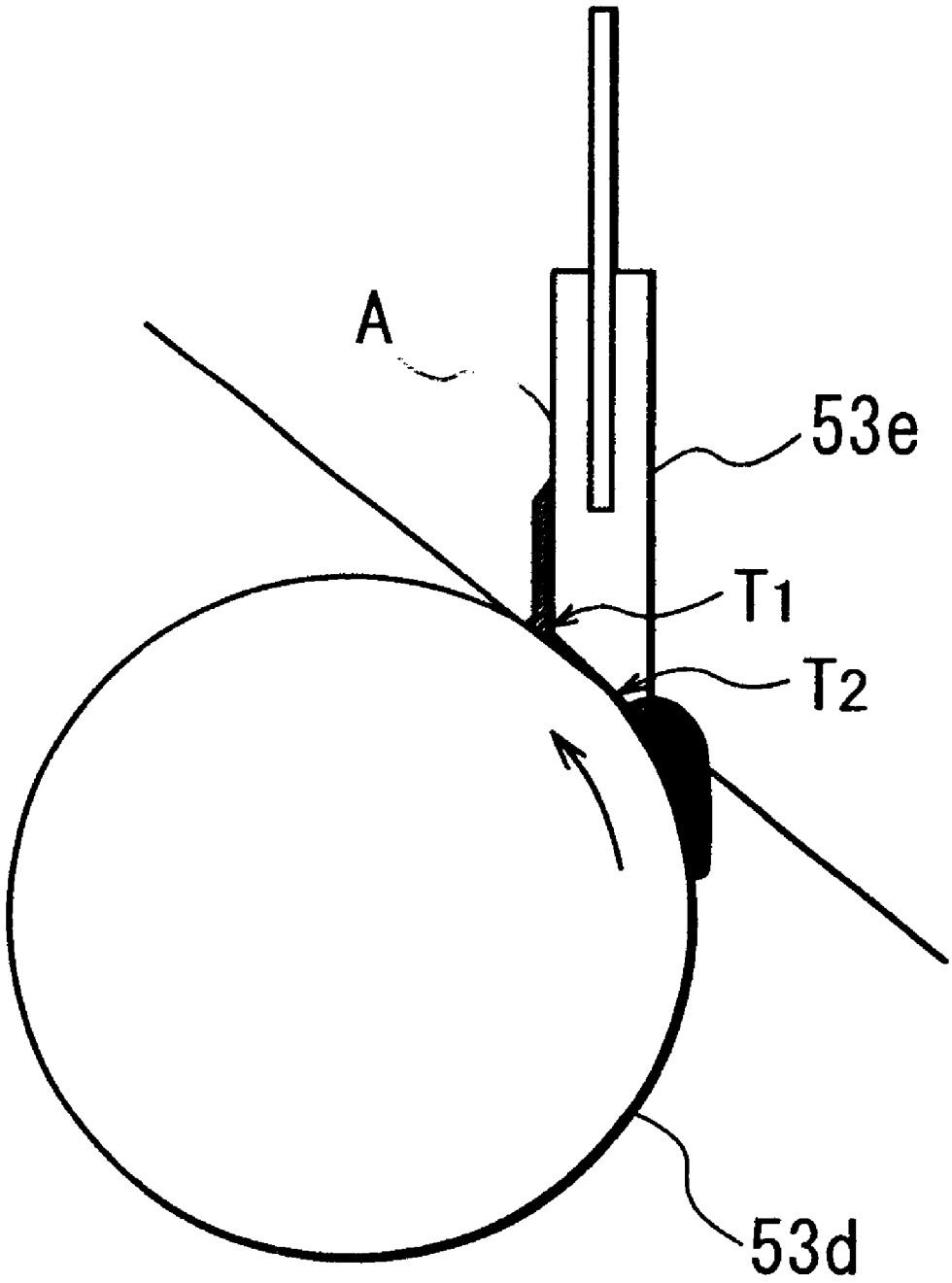
FIG. 6 is a schematic sectional view of an abutting state of a chamfered regulation blade with an application roller.

More specifically, in the case where the chamfered regulation lade 53*e* having the chamfer angle θ of 30–70 degrees is disposed to abut the application roller 53*d* so that the extension direction of the regulation blade 53*e* toward the application roller 53*d* is substantially counter to the circumferential moving direction of the (rotating) application roller 53*d*, if the abutting angle ø (formed between the regulation blade surface S and the tangent line 1 of application roller at the abutting position) is small (e.g., below 30 degrees), the release agent is liable to be slipped through the abutting portion to be excessively accumulated at a surface (the surface A as shown in FIG. 6). In the present invention, the abutting angle ø is set to be in an appropriate range of 30–50 degrees in combination with the chamber angle θ of 30–70 degrees to avoid the formation of the above-mentioned wedge spacing. In addition, even when the applied release agent is slipped through the abutting portion to attach the surface S of the regulation blade 53*e*, the abutting angle ø of 30–50 degrees is effective in preventing an excessive accumulation of the release agent (at the regulation blade surface S) causing the dropping phenomenon of the excessive release agent. Further, when the abutting angle ø is large (e.g., above 50 degrees), a resultant chamfering effect is lessened to decrease an application amount of the regulation blade, thus being liable to cause an occurrence of offset phenomenon of toner (particles).

In the present invention, the application roller 53*d* may preferably have a surface hardness (ASKER-C hardness) of 25–50 degrees, more preferably 30–45 degrees.

By using the application roller 53*d* having a surface hardness within the above range, it becomes possible to effectively suppress an occurrence of image failure accompanied with drop-like stains of an excessive release agent even when the application amount of release agent (such as silicone oil) finally applied to the fixation roller is set to a higher value within the range of 20–30 mg/A4-sized sheet.

The release agent application means 53, in addition to the application roller 53*d* and the regulation blade 53*e*, further includes other additional members, similarly as in the conventional one shown in FIG. 5, such as an oil tank 53*a* and conveyance rollers 53*b* and 53*c*, whereby an oily release agent such as a silicone oil is supplied to the surface of the application roller 53*d* The application roller 53*d* may preferably have a surface layer of a rubber in order to enhance an adhesiveness to the regulation blade 53*e*. The surface layer may suitably be a silicone rubber layer in view of less attachment of toner.

The fixing device of the present invention may preferably includes other members, similarly as in the conventional fixing device shown in FIG. 5, such as roller cleaning units 54 and 55; heaters 56 and 57 (e.g., halogen lamps) disposed inside the fixation roller 51 and the pressure roller 52, respectively; thermistors 58 and 59 and their temperature control circuits for controlling temperatures of the heaters 56 and 57, respectively; and a removal blade 60 for removing an excessive release agent remaining on the pressure roller surface.

The regulation blade 53*e* used in the present invention may preferably be a rubber blade, more preferably a silicone rubber blade. The regulation blade 53*e*, as described above, has been subjected to chamfering or beveling at a corner abutting the application roller 53*d* so as to have a chamfer at a prescribed chamfer angle θ as shown in FIG. 2.

Referring to FIG. 2, the chamfering of the regulation blade 53*e* has been performed to provide a chamfer angle θ of 30–70 degrees as described above, preferably satisfying the following relationship:

$$W > Y \tan\theta,$$

particularly $$(1/2)W > Y \tan\theta,$$

wherein W denotes a thickness of the regulation blade 53*e* and Y denotes a length of the chamfer along the extension line of the surface S of regulation blade 53*e*.

The regulation blade 53*e* used in the present invention shown in FIG. 2 is disposed to abut the application roller 53*d* in a counter direction to the application roller 53*d* similarly as in the regulation blade 53*e* shown in FIG. 6, i.e., so that the extension direction of the regulation blade 53*e* toward the application roller 53*d* is substantially counter to the circumferential moving direction of the rotating application roller 53*d*.

However, the regulation blade 53*e* used in the fixing device of the present invention may preferably be disposed to abut the application roller 53*d* at least at an edge (corner) T1, not at an edge (corner) T2 (as shown in FIG. 6). As described above, the abutment at the edge T2 causes the excessive accumulation (at the surface A) of the release agent slipped through the abutting portion (as shown in FIG. 6), thus leading to the dropping phenomenon of the release agent.

The regulation blade 53*e* used in the present invention abuts the application roller 53*d* at an abutting angle ø of 30–50 degrees as described above. In the present invention, the chamfer angle θ may preferably be set to be larger than the abutting angle ø. In other words, the abutting angle ø of the regulation blade 53*e* with the application roller 53*d* may preferably be set so as not to exceed the chamfer angle θ of the regulation blade 53*e*.

In this regard, in some cases where the abutting angle ø is somewhat larger than the chamfer angle θ (e.g., at most 10 degrees), the chamfer of the regulation blade 53*e* abutting the application roller 53*d* can be deformed to be placed in an abutting state at the edge T1, not the edge T2, depending on the material of the regulation blade 53*e*. Such an abutting state is also within the scope of the present invention so long as the abutment of the regulation blade 53*e* with the application roller 53*d* at the edge T1 is achieved.

Figure 4:
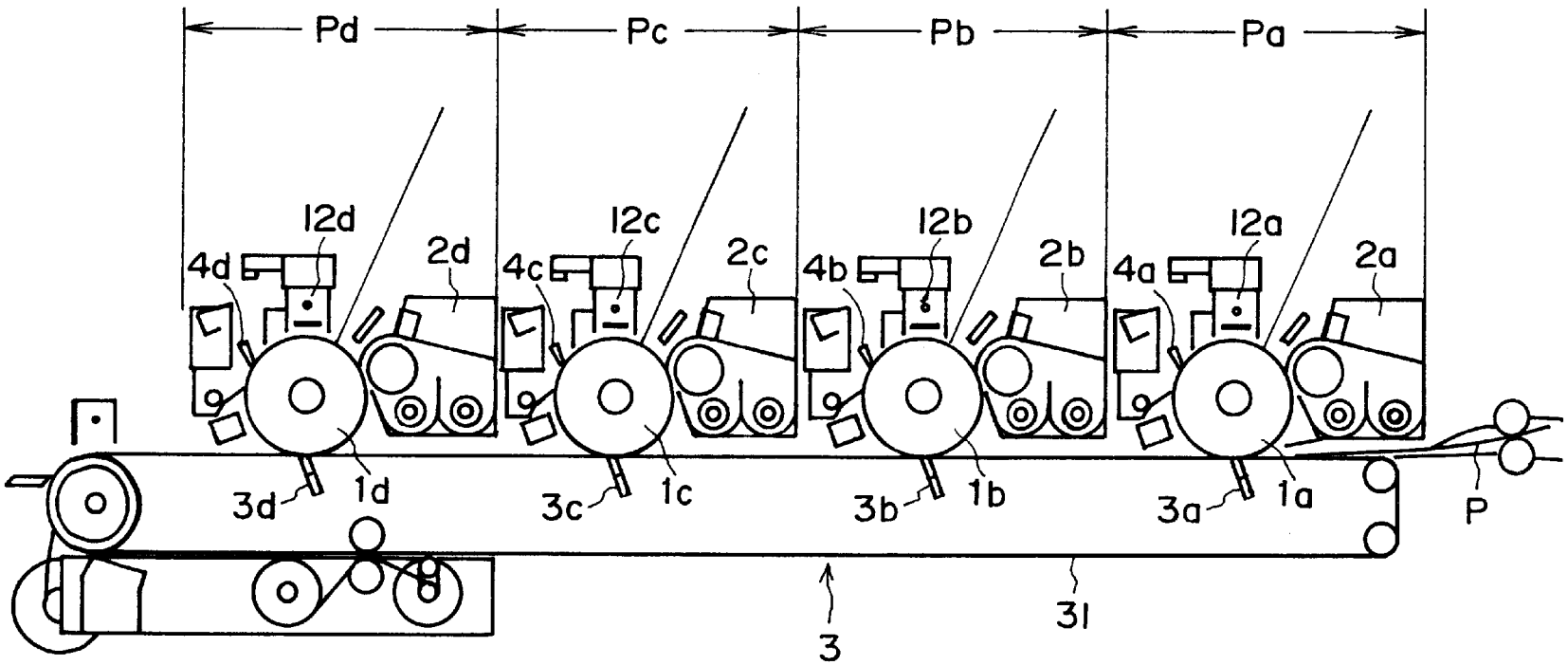
FIG. 4 is an enlarged view of an embodiment of image forming means constituting the conventional image forming apparatus shown in FIG. 3.

The image forming apparatus according to the present invention includes the above-mentioned fixing device as shown in FIGS. 1 and 2 and at least one image forming means (e.g., four image forming means as shown in FIG. 4).

By the use of the fixing device of the present invention, the resultant image forming apparatus allows a high-speed image formation with a larger number of sheets to be processed per unit time, particularly while suppressing attachment of the release agent (such as silicone oil) onto the recording material in the form of, e.g., oily drops or oily streaks, thus performing a suitable image formation.

Except for the fixing device as shown in FIGS. 1 and 2 used in the fixation step, the image forming apparatus of the present invention may include any structural members used in preceding image forming steps. Specifically, so long as image formation is performed by using such a fixation step that a yet unfixed toner image is heat-fixed by the above-mentioned fixing device of the present invention, structural members for forming the yet unfixed toner image may appropriately be selected from those used in the conventional image forming apparatus.

Hereinbelow, the present invention will be described based on a specific example as one of preferred embodiments of the present invention with reference to FIGS. 1–3.

EXAMPLE

In this example, a fixing device as shown in FIG. 1 including a regulation blade 53*e* as shown in FIG. 2 was used.

The regulation blade 53*e* as shown in FIG. 2 was comprised of stainless steel sheet (SUS) coated with a layer of silicone rubber to have a thickness (W) of 3 mm and a free length (X) of 4 mm, and was provided with a chamfer designed to have two edges (corners) T1 and T2, a length Y (a length in extension direction of a surface S) of 0.5 mm, and a chamfer angle θ of 45 degrees.

The thus designed regulation blade 53*e* was disposed to abut an application roller 53*d* at an abutting pressure of 3000 gf in a direction counter to a circumferential moving direction of the application roller 53*d*, whereby an amount of a release agent (silicone oil in this example) applied to a fixation roller 51 was controlled to be 20 mg/A4-sized sheet (OHP film in this example).

In the present invention, the abutting pressure of the regulation blade 53*e* exerted on the application roller 53*d* may preferably be 2000–4000 gf.

Incidentally, in some cases, powders of toner and paper can be transferred from the fixing roller 51 to the application roller 53*d* abutting the fixing roller 51, thus causing an occurrence of attachment of these powders to the regulation blade 53*e*. In the case of using a regulation blade 53*e* of fluorine-containing rubber, the above powders are much liable to attach onto the regulation blade compared with that of silicone rubber (used in this example), due to a larger surface energy of fluorine-containing rubber (than the silicone rubber). When a large amount of such powders is attached onto the regulation blade (of fluorine-containing rubber), an amount of silicone oil (as the release agent) slipped through an abutting portion (between the regulation blade 53*e* and the application roller 53*d*) becomes ununiform even if a chamfered regulation blade is used, thus resulting in an occurrence of oily streaks in some cases.

In order to suppress the occurrence of such oily streaks, the regulation blade 53*e* of silicone rubber was used in this example.

Further, the regulation blade 53*e* of silicone rubber did not contain a filler of, e.g., silica powder. This is because of a regulation blade of silicone rubber containing a large amount of silica powder, the regulation blade is gradually abraded in repetitive use due to an abrasive function of the filler (silica powder). As a result, the chamfered shape of the regulation blade cannot be retained, thus gradually failing to control the originally set regulation amount of silicone oil. In view of this difficulty, in this example, the filler such as silica powder was not employed in the regulation blade.

Figure 3:
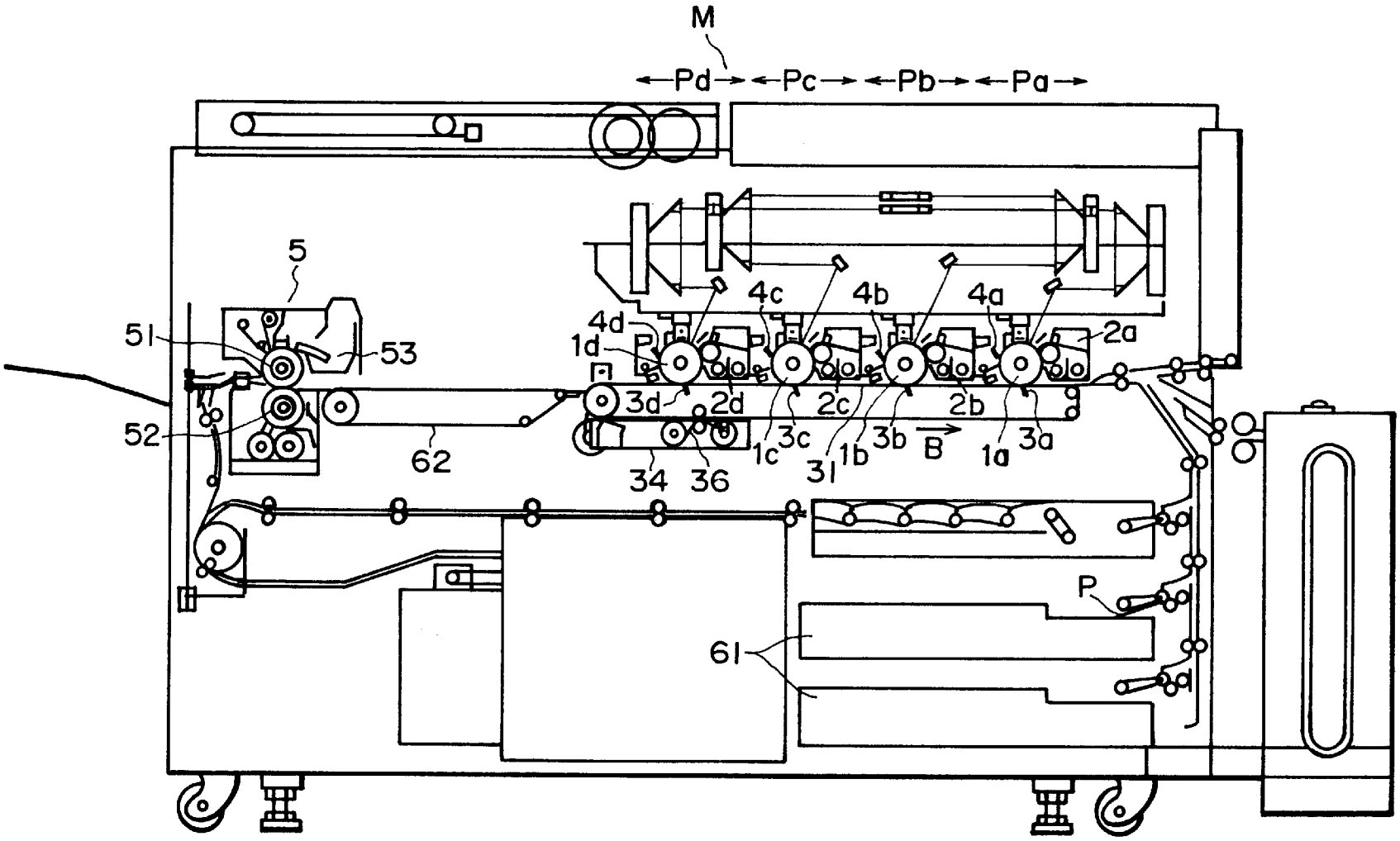
FIG. 3 is a schematic sectional view of an embodiment of a conventional image forming apparatus.

By using the above-prepared and designed regulation blade 53*e*, a color image formation on 100 sheets of oHP film was performed in an image forming apparatus as shown in FIG. 3 including the fixing device as shown in FIG. 1 while changing an abutting angle ø of the regulation blade 53*e* with the application roller 53*d* and a surface hardness (ASKER-C hardness) of the application roller 53*d*, thus counting the number of sheets accompanied with image failure on a color image region per 100 sheets of recording material (OHP film in this example).

The results are shown in Table below.

TABLE

| Hardness | Abutting angle ø (deg.) | | | | |
|---|---|---|---|---|---|
| (deg.) | 20 | 25 | 30 | 40 | 50 |
| 25 | 30/100 | 23/100 | 5/100 | 4/100 | 4/100 |
| 30 | 15/100 | 5/100 | 0/100 | 0/100 | 0/100 |
| 35 | 19/100 | 4/100 | 0/100 | 0/100 | 0/100 |
| 40 | 20/100 | 5/100 | 0/100 | 0/100 | 0/100 |
| 45 | 23/100 | 7/100 | 0/100 | 0/100 | 0/100 |
| 50 | 100/100 | 63/100 | 5/100 | 4/100 | 4/100 |

As is apparent from the above results, the frequency of occurrence of image failure becomes smaller with an increasing abutting angle ø and the occurrence of image failure is substantially suppressed at the abutting angle ø of above 25 deg., particularly at least 30 deg.

In the case of the abutting angle ø of 50 deg. somewhat larger than the chamfer angle θ of 45 deg., it is found to achieve suppression of occurrence of image failure similarly as in the case of 40 deg. (somewhat smaller than the chamfer angle θ of 45 deg.).

Incidentally, in the case of the abutting angle ø of 60 deg. (not shown in Table), the toner particles carried on the OHP film caused the offset onto the application roller.

Further, in the cases of the abutting angles ø of 30–50 deg., when the application roller 53*d* has the surface hardness (ASKER-C hardness) of 30–45 deg., better results are attained compared with the cases of the surface hardness of 25 deg. and 50 deg.

Particularly, in the cases of combinations of the abutting angles ø of 30–50 deg. (exceeding 25 deg.) with the surface hardness of 30–45 deg., no image failure is observed.

Another image formation was performed in the same manner as in the above example except that the chamfer angle θ (45 deg.) and the length Y (0.5 mm) for the chamfer of the regulation blade 53*e* were variously changed within ranges of: $30 \leqq \theta \leqq 70$ (deg.) and $0.3 \leqq Y \leqq 1.0$ (mm) with the proviso that θ and Y satisfied the relationship of: 3 (mm) $> Y \cdot \tan \theta$.

As a result, substantially similar image failure suppression effects as in the above example were achieved.

As described above, in the case where the amount of release agent was regulated by the chamfered regulation blade, it was found more effective to set the abutting angle ø of the regulation blade with the application roller in the range of 30–50 deg. and the surface hardness (ASKER-C hardness) of the application roller in the range of 30–45 deg.

This may be attributable to the following phenomena.

When the abutting angle ø becomes small (e.g., below 30 deg.), the surface of the regulation blade 53*e* (e.g., the surface A shown in FIG. 6), where silicone oil slipped through the abutting portion is present, becomes closer to the surface of the application roller 53*d*. As a result, such a silicone oil is liable to attach onto the surface of the regulation blade 53*e*. On the other hand, when the abutting angle ø is increased to the above range (i.e., 30–50 deg.), the distance between the surfaces of the regulation blade 53*e* and the application roller 53*d* becomes larger, thus less liable to cause the attachment of silicone oil onto the regulation blade surface.

Further, when the application roller 53*d* has an appropriate hardness (e.g., 30–45 deg. as the ASKER-C hardness), a surface layer of the application roller 53*d* is appropriately deformed depending on the abutting edge of the regulation blade 53*e*, thus ensuring a sufficient abutting (contact) state between the edge of the regulation blade 53*e* and the application roller 53*d*. As a result, an amount of silicone oil slipped through the abutting portion and attached onto the surface of the regulation roller 53*e* becomes smaller, thus preventing dropping thereof onto the application roller surface to suppress the occurrence of image failure. However, when the application roller surface layer is excessively softened, the deformation degree thereof becomes too large. As a result, the application roller surface is closer to the surface of the regulation blade 53*e*, thus being liable to cause the silicone oil attachment onto the regulation blade surface to result in occurrence of image failure.

When the surfaces of regulation blades 53*e* disposed in abutment with application rollers 53*d* having the surface hardness of 30–45 deg. at the abutting angle ø of 30–50 deg. were observed, less amounts of silicone oil were merely attached thereto.

As described hereinabove, according to the present invention, by abutting a specific chamfered regulation blade having a chamfer angle θ of 30–70 deg. against an application roller (preferably having a surface hardness of 25–50 deg., particularly 30–45 deg.) at a specific edge (T1 as shown in FIG. 2) at an abutting angle ø of 30–50 deg. in an initial state in a direction counter to a circumferential moving direction of the application roller, it becomes possible to stably apply a desired amount of release agent (e.g., silicone oil), thus effectively suppressing an occurrence of image failure.

As a result, it is possible to provide a high-speed color image forming apparatus equipped with the fixing device of heat fixation scheme.

Incidentally, the effect of suppressing the occurrence of image failure caused by attachment of release agent (such as silicone oil) onto the surface of OHP film in the form of drops can also be achieved by appropriately modifying a shape, a material, abutting conditions, etc., e.g., by using a fluorine-containing rubber regulation blade in place of the silicone rubber regulation blade used in the above example.

What is claimed is:

1. A fixing device for an image forming apparatus for heat-fixing a yet unfixed image formed on a recording material by passing and conveying the recording material between a pair of rollers, comprising:

a pair of a fixation roller and a pressure roller which are rotatably disposed in contact with each other under pressure, and an applicator for applying a release agent onto the fixation roller, said applicator comprising an application roller disposed in contact with the fixation roller and a regulation blade for regulating an amount of the release agent applied onto the surface of the application roller; wherein the regulation blade is disposed to abut the application roller so that an extension direction of the regulation blade towards the application roller is substantially counter to a circumferential moving direction of the application roller and is provided with a chamfer at a corner between major and minor surfaces of the regulation blade at a chamfer angle of 30–70 degrees between an extension direction of the major surface and the chamfer of the regulation blade, the regulation blade being disposed to abut the application roller at an abutting angle of 30–50 degrees between the major surface and a tangent line of the application roller at a position in abutment with the regulation blade.

2. A device according to claim 1, wherein the application roller has a surface hardness (ASKER-C hardness) of 25–50 degrees.

3. A device according to claim 1, wherein the application roller has a surface hardness (ASKER-C hardness) of 30–45 degrees.

4. A device according to claim 1, wherein the release agent to be applied onto the fixing roller comprises an oil.

5. A device according to claim 4, wherein the oil is a silicone oil.

6. A device according to claim 1, wherein the regulation blade comprises a rubber blade.

7. A device according to claim 6, wherein the rubber blade is a silicone rubber blade.

8. A device according to claim 1, wherein the application roller has a surface rubber layer.

9. A device according to claim 8, wherein the surface rubber layer comprises a silicone rubber layer.

10. An image forming apparatus, comprising image forming means for forming an unfixed image; and a fixing device according to any one of claims 1–9.

11. An apparatus according to claim 10, wherein the image forming means is divided into a plurality of image forming means for forming images of a plurality of colors, respectively.

* * * * *

UNITED STATES PATENT AND TRADEMARK OFFICE

CERTIFICATE OF CORRECTION

PATENT NO. : 6,580,893 B2
DATED : June 17, 2003
INVENTOR(S) : Jiro Ishizuka

It is certified that error appears in the above-identified patent and that said Letters Patent is hereby corrected as shown below:

Column 1,
Line 62, “1c).” should read -- 1d). --.

Column 2,
Line 1, “1b” should read -- 1b, 1c --.

Column 3,
Line 11, “therein an” should read -- therein a --.
Line 50, “do not” should read -- does not --.

Column 5,
Line 25, “became” should read -- become --.

Column 6,
Line 40, “regulating” should read -- regulate --.

Column 8,
Line 7, “lade” should read -- blade --.
Line 54, “includes” should read -- include --.

Column 10,
Line 42, “form” should read -- formed --.
Line 59, “oHP” should read -- OHP --.

Signed and Sealed this

Sixteenth Day of December, 2003

JAMES E. ROGAN
*Director of the United States Patent and Trademark Office*